US007897551B2

(12) United States Patent
Tamoto et al.

(10) Patent No.: US 7,897,551 B2
(45) Date of Patent: Mar. 1, 2011

(54) LUBRICANTS FOR POWER TRANSMISSION

(75) Inventors: Yoshitaka Tamoto, Chiba (JP); Hitoshi Hata, Chiba (JP); Yukitoshi Fujinami, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 484 days.

(21) Appl. No.: 11/410,072

(22) Filed: Apr. 25, 2006

(65) Prior Publication Data

US 2007/0037716 A1 Feb. 15, 2007

(30) Foreign Application Priority Data

Apr. 28, 2005 (JP) ..... 2005-132952

(51) Int. Cl.
*C10M 105/36* (2006.01)
*C07C 55/02* (2006.01)

(52) U.S. Cl. ..... 508/496; 508/506

(58) Field of Classification Search ..... 508/496, 508/506

See application file for complete search history.

(56) References Cited

U.S. PATENT DOCUMENTS

| | | | | |
|---|---|---|---|---|
| 3,172,897 | A | 3/1965 | Rai et al. | |
| 3,398,165 | A | 8/1968 | Duling et al. | |
| 4,786,427 | A | 11/1988 | Dare-Edwards | |
| 5,240,624 | A * | 8/1993 | Koch | 508/200 |
| 5,318,711 | A * | 6/1994 | Evans et al. | 508/485 |
| 5,939,366 | A | 8/1999 | MacNeil et al. | |
| 2002/0183210 | A1 * | 12/2002 | Sowerby et al. | 508/378 |

FOREIGN PATENT DOCUMENTS

| | | |
|---|---|---|
| GB | 1 257 472 | 12/1971 |

* cited by examiner

*Primary Examiner* — Glenn A Caldarola
*Assistant Examiner* — Vishal Vasisth
(74) *Attorney, Agent, or Firm* — Oblon, Spivak, McClelland, Maier & Neustadt, L.L.P.

(57) ABSTRACT

There is provided lubricants for power transmission which exhibit not only a high coefficient of traction but also a high flash point. The lubricants for power transmission according to the present invention contains an alicyclic alcohol carboxylic diester compound represented by the general formula (1):

$$R^1—CO—O—(X^1)_m—Z—(X^2)_n—O—CO—R^2 \quad (1)$$

wherein Z is a cycloalkylene group having 3 to 12 carbon atoms; $R^1$ and $R^2$ are each independently a chain hydrocarbon group having 3 to 20 carbon atoms; $X^1$ and $X^2$ are each independently a linear or branched alkylene group having 1 to 5 carbon atoms; and m and n are respectively an integer of 0 or 1.

9 Claims, No Drawings

LUBRICANTS FOR POWER TRANSMISSION

FIELD OF THE INVENTION

The present invention relates to lubricants for power transmission, and more particularly to lubricants for power transmission which have a high coefficient of traction as well as a high flash point.

BACKGROUND OF THE INVENTION

In recent years, continuously variable transmissions (hereinafter occasionally referred to merely as "CVT") have been extensively used as devices for power transmissions. The CVT is a transmission capable of continuously changing an output rotation speed relative to a constant input rotation speed, and various types of CVT are known in the art. The CVT is typically classified into a friction drive type in which a power is transmitted by means of a metallic belt or chain, and a traction drive type in which a power is transmitted without using such an element.

Comparing the friction drive type CVT with the traction drive type CVT, the traction drive type CVT is generally capable of transmitting a large capacity of power nevertheless its small scale. For this reason, the application fields of the traction drive type CVT are continuously expanded. For example, power transmissions having a so-called traction drive type transmission mechanism which include not only continuously variable speed-reducing or speed-increasing devices for industrial equipments and continuously variable transmissions for automobiles but also transmissions into which a principle of the traction drive or a part thereof is incorporated, have been increasingly put into practice.

Further, the power transmissions having a traction drive type transmission mechanism have been recently utilized in more extensive application fields such as airplanes and helicopters, and practically used, for example, for controlling a rotation speed of generators of airplanes or rotors of helicopters.

Lubricants for power transmission, in particular, those for power transmission having a traction drive type transmission mechanism, are required to have a high coefficient of traction for enhancing a transmission performance thereof. As the lubricants satisfying such a requirement, there have been proposed alicyclic hydrocarbon compounds or naphthene ring-containing esters. Examples of the alicyclic hydrocarbon compounds include dicyclohexyl compounds such as typically 2-methyl-2,4-dicyclohexyl pentane, and dimerized norbornanes (refer to Japanese Patent Application Laid-open Nos. 7664/1972 and 95295/1991), whereas examples of the naphthene ring-containing esters include those compounds such as typically an ester of cyclohexanol and cyclohexanecarboxylic acid, a diester of cyclohexanecarboxylic acid and neopentyl glycol and an ester of succinic acid and cyclohexanol (refer to Japanese Patent Publication Nos. 31373/1994, 31365/1994, 31366/1994, 74350/1995, 74351/1995 and 293265/1999).

The alicyclic hydrocarbon compounds have advantages such as a high power transmission performance because of a high coefficient of traction thereof, but tend to exhibit a slightly low flash point. On the other hand, the naphthene ring-containing esters have a relatively high flash point, but tend to be insufficient in coefficient of traction. Therefore, in the application fields requiring especially a high safety against firing, for example, when applied to power transmissions having a traction derive type transmission mechanism including a traction drive type CVT mechanism for controlling a rotation speed of generators of airplanes and rotors of helicopters, any of these compounds tends to be unsatisfactory as a lubricant therefor.

For these reasons, it has been required to provide lubricants for power transmission which exhibit not only a high coefficient of traction but also a high flash point.

SUMMARY OF THE INVENTION

The present invention has been made to solve the above conventional problems. An object of the present invention is to provide lubricants for power transmission which have not only a high coefficient of traction but also a high flash point.

The inventors have found that a specific alicyclic alcohol carboxylic diester compound exhibits both a high coefficient of traction and a high flash point. The present invention has been accomplished on the basis of the finding.

Thus, the present invention provides:

1. A lubricant for power transmission comprising an alicyclic alcohol carboxylic diester compound represented by the general formula (1):

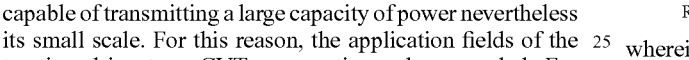

$$R^1—CO—O—(X^1)_m—Z—(X^2)_n—O—CO—R^2 \quad (1)$$

wherein Z is a cycloalkylene group having 3 to 12 carbon atoms; $R^1$ and $R^2$ are each independently a chain hydrocarbon group having 3 to 20 carbon atoms; $X^1$ and $X^2$ are each independently a linear or branched alkylene group having 1 to 5 carbon atoms; and m and n are respectively an integer of 0 or 1.

2. The lubricant for power transmission as described in the above aspect 1, wherein at least one of $R^1$ and $R^2$ is a branched alkyl group having 3 to 12 carbon atoms.

3. The lubricant for power transmission as described in the above aspect 1 or 2, wherein at least one of $R^1$ and $R^2$ is a branched alkyl group having 6 to 10 carbon atoms.

4. The lubricant for power transmission as described in any one of the above aspects 1 to 3, wherein the alicyclic alcohol carboxylic diester compound has a flash point of 180° C. or higher.

5. The lubricant for power transmission as described in any one of the above aspects 1 to 4, wherein the alicyclic alcohol carboxylic diester compound is contained in an amount of 80% by mass or larger on the basis of the weight of the lubricant.

6. The lubricant for power transmission as described in any one of the above aspects 1 to 5, wherein the lubricant is used in a power transmission having a traction drive type transmission mechanism.

7. The lubricant for power transmission as described in any one of the above aspects 1 to 6, wherein the lubricant is a grease.

EFFECT OF THE INVENTION

The lubricant for power transmission according to the present invention exhibits not only a high coefficient of traction but also a high flash point. Therefore, when used in power transmissions having a traction drive type transmission mechanism, the lubricant allows the power transmissions to exhibit a high power transmission performance and shows a high safety upon handling. For this reason, the lubricant of the present invention is useful as not only a lubricant for power transmissions of industrial equipments or automobiles but also that for power transmissions of airplanes.

DETAILED DESCRIPTION OF THE INVENTION

The lubricant for power transmission according to the present invention contains an alicyclic alcohol carboxylic diester compound represented by the general formula (1):

$$R^1—CO—O—(X^1)_m—Z—(X^2)_n—O—CO—R^2 \quad (1)$$

wherein Z is a cycloalkylene group having 3 to 12 carbon atoms; $R^1$ and $R^2$ are each independently a chain hydrocarbon group having 3 to 20 carbon atoms; $X^1$ and $X^2$ are each independently a linear or branched alkylene group having 1 to 5 carbon atoms; and m and n are respectively an integer of 0 or 1.

In the above general formula (1), Z represents a cycloalkylene group having 3 to 12 carbon atoms. The diester compound represented by the above general formula (1) in which Z is a cycloalkylene group having 3 to 12 carbon atoms, exhibits both a high flash point and a high coefficient of traction.

Examples of the cycloalkylene group having 3 to 12 carbon atoms as Z in the general formula (1) include residual groups obtained by removing two hydroxyl group from cycloalkanediols such as cyclohexanediol, bicycloalkanediols such as bicyclo[2.2.1]heptanediol, and cycloalkane dialcohols such as cyclohexane dimethanol. Specific examples of the cycloalkylene group having 3 to 12 carbon atoms as Z in the general formula (1) include a cyclopropylene group; various cyclobutylene groups such as 1,2-cyclobutylene and 1,3-cyclobutylene; various cyclopentylene groups such as 1,2-cyclopentylene and 1,3-cyclopentylene; various cyclohexylene groups such as 1,2-cyclohexylene, 1,3-cyclohexylene and 1,4-cyclohexylene; various cycloheptylene groups such as 1,2-cycloheptylene, 1,3-cycloheptylene and 1,4-cycloheptylene; various cyclooctylene groups such as 1,2-cyclooctylene, 1,3-cyclooctylene, 1,4-cyclooctylene and 1,5-cyclooctylene; various cyclononylene groups; various cyclodecylene groups; a bicycloheptylene group; a bicyclohexylene group; a naphthalene group; an anthracene group; and a methylcyclohexylene group.

These cycloalkylene groups may be substituted with one or more alkyl groups having 1 to 3 carbon atoms.

Among these cycloalkylene groups, in view of good availability and enhancement in coefficient of traction of the obtained lubricant, preferred are cycloalkylene groups having 4 to 10 carbon atoms, and more preferred are cycloalkylene groups having 6 to 8 carbon atoms. Further, among them, in view of allowing the resultant lubricant to exhibit a high coefficient of traction and a high flash point notwithstanding its low viscosity, still more preferred are a 1,2-cyclohexylene group and a residual group obtained by removing hydroxyl groups from 1,2-cyclohexane dimethanol.

In the above general formula (1), $R^1$ and $R^2$ are each independently a chain hydrocarbon group having 3 to 20 carbon atoms which involves linear or branched chain hydrocarbon groups. The chain hydrocarbon group may have an unsaturated bond, but is preferably a saturated hydrocarbon group in view of a good stability.

Typical examples of the branched chain hydrocarbon group among these chain hydrocarbon groups as $R^1$ and $R^2$, include branched alkyl groups such as isopropyl, isobutyl, isopentyl, 1-ethylpentyl, isohexyl, isooctyl, 2,4,4-trimethylpentyl, isononyl, isodecyl, isoundecyl, isododecyl, isotridecyl, isotetradecyl, isopentadecyl, isohexadecyl, isoheptadecyl, isooctadecyl and isoeicosyl. Typical examples of the linear chain hydrocarbon group as $R^1$ and $R^2$ include linear alkyl groups having carbon numbers corresponding to those of the above respective branched chain hydrocarbon groups.

In the present invention, the $R^1$ and $R^2$ in the general formula (1) may be respectively one group selected from these chain hydrocarbon groups or a mixture of any two or more thereof.

In addition, $R^1$ and $R^2$ are each independently selected from these chain hydrocarbon groups, and may be different from each other.

Among these chain hydrocarbon groups, in view of remarkable effect of enhancing the coefficient of traction, at least one of $R^1$ and $R^2$ is preferably a branched alkyl group having 3 to 12 carbon atoms, and more preferably both of $R^1$ and $R^2$ are branched alkyl groups having 3 to 12 carbon atoms. Further, both of $R^1$ and $R^2$ are still more preferably branched alkyl groups having 6 to 10 carbon atoms, and most preferably both groups are 2,4,4-trimethylpentyl groups.

In the above general formula (1), $X^1$ and $X^2$ are each independently a linear or branched alkylene group having 1 to 5 carbon atoms. Examples of the linear or branched alkylene group having 1 to 5 carbon atoms as $X^1$ and $X^2$ include a methylene group, an ethylene group, an n-propylene group, an isopropylene group, various butylene groups and various pentylene groups. Among these alkylene groups, preferred are a methylene group, an ethylene group and an n-propylene group, and more preferred is a methylene group.

In the above general formula (1), m and n are respectively an integer of 0 or 1. The condition where the integers m and n are 0 means that none of $X^1$ and $X^2$ group are present, and Z is directly bonded to the oxygen (O) atoms through single bonds. The integers m and n may be different from each other, and only one of the integers m and n may be 1.

The alicyclic alcohol carboxylic diester compound represented by the above general formula (1) preferably has the following properties. That is, the diester compound preferably has a coefficient of traction of 0.080 or higher as measured at 60° C., a flash point of 180° C. or higher, a kinematic viscosity of 10 to 50 $mm^2/s$ as measured at 40° C., a viscosity index of 40 or higher and more preferably 45 or higher, and a pour point of −35° C. or lower and more preferably −40° C. or lower.

The alicyclic alcohol carboxylic diester compound represented by the above general formula (1) may be synthesized (produced), for example, by the following method. That is, the diester may be produced by esterifying (A) 2.01 to 2.10 mol of an aliphatic chain monocarboxylic acid having 4 to 21 carbon atoms and preferably an aliphatic branched chain monocarboxylic acid having 4 to 13 carbon atoms with (B) 1 mol of an alicyclic alcohol represented by the general formula (2):

$$HO—(X^1)_m—Z—(X^2)_n—OH \quad (2)$$

wherein Z, $X^1$, $X^2$, m and n have the same meanings as defined in the general formula (1), in the presence or absence of a catalyst, and then washing the resultant esterification reaction product with alkali.

The aliphatic chain monocarboxylic acid having 4 to 21 carbon atoms as the component (A) may be those monocarboxylic acids corresponding to the $R^1$ and $R^2$ groups in the general formula (1).

The alicyclic alcohol as the component (B) may be those alcohols represented by the general formula (2) which have a moiety corresponding to "$—(X^1)_m—Z—(X^2)_n—$" in the general formula (1). Specific examples of the alicyclic alcohol represented by the general formula (2) in which m and n are 1, include cyclopropane dimethanol, cyclopropane diethanol, cyclopropane dipropanol, cyclopropane dibutanol, cyclopropane dipentanol, cyclobutane dimethanol, cyclobutane diethanol, cyclobutane dipropanol, cyclobutane dibutanol, cyclobutane dipentanol, cyclopentane dimethanol, cyclopentane diethanol, cyclopentane dipropanol, cyclopentane dibutanol, cyclopentane dipentanol, cyclohexane dimethanol, cyclohexane diethanol, cyclohexane dipropanol, cyclohexane dibutanol, cyclohexane dipentanol, cycloheptane dimethanol, cycloheptane diethanol, cycloheptane dipropanol, cycloheptane dibutanol, cycloheptane dipentanol, cyclooctane dimethanol, cyclooctane diethanol, cyclooctane dipropanol, cyclooctane dibutanol and cyclooctane dipentanol.

The positions of the two alkanol substituent groups in the alicyclic alcohol molecule are not particularly limited, and any of position isomers thereof may be used in the esterification reaction. For example, in the case of cyclohexane dimethanol, 1,2-cyclohexane dimethanol, 1,3-cyclohexane dimethanol and 1,4-cyclohexane dimethanol may be used alone or in combination of any two or more thereof in the esterification reaction.

Also, the alicyclic alcohol is present in either a cis-isomer or a trans-isomer depending upon a steric configuration of the two alkanol groups, and any of the cis isomer solely, the trans-isomer solely and a mixture of the cis- and trans-isomers may be used in the esterification reaction.

Specific examples of the alicyclic alcohol represented by the general formula (2) in which m and n are 0, include cyclopropanediol, cyclobutanediol, cyclopentanediol, cyclohexanediol, cycloheptanediol, cyclooctanediol, cyclononanediol, cyclodecanediol, bicyclo[2.2.1]heptanediol and bicyclo[4.4.0]decanediol.

The positions of hydroxyl substituent groups of the above alicyclic dihydric alcohol are not particularly limited, and any of position isomers thereof may be used in the present invention. For example, as the cyclohexanediol, there may be used any of 1,2-cyclohexanediol, 1,3-cyclohexanediol and 1,4-cyclohexanediol. Also, as the bicyclo[4.4.0]octene diol, there may be used any of position isomers thereof including bicyclo[4.4.0]octene-1,2-diol, bicyclo[4.4.0]octene-1,3-diol, bicyclo[4.4.0]octene-1,4-diol, bicyclo[4.4.0]octene-1,5-diol, bicyclo[4.4.0]octene-1,6-diol, bicyclo[4.4.0]octene-1,7-diol, bicyclo[4.4.0]octene-1,8-diol, bicyclo[4.4.0]octene-2,3-diol, bicyclo[4.4.0]octene-2,4-diol, bicyclo[4.4.0]octene-2,5-diol, bicyclo[4.4.0]octene-2,6-diol and bicyclo[4.4.0]octene-2,7-diol. Among these position isomers, vic-diols in which the two hydroxyl substituent groups are respectively bonded to adjacent carbon atoms thereof are preferred because of excellent hydrolysis stability thereof. Examples of the vic-diols include 1,2-cyclohexanediol, bicyclo[4.4.0]octene-1,2-diol and bicyclo[4.4.0]octene-2,3-diol.

Also, these alicyclic dihydric alcohols are present in the form of either a cis-isomer or a trans-isomer depending upon a steric configuration of the hydroxyl groups, and any of the cis isomer solely, the trans-isomer solely and a mixture of the cis- and trans-isomers may be used in the present invention.

In addition, specific examples of the alicyclic alcohol represented by the general formula (2) in which only one of m and n is 1, include methylol cyclohexanol.

Upon the esterification reaction, the component (A) (acid component) may be used, for example, in terms of chemical equivalent, in an amount of 2.01 to 2.10 mol and preferably 2.01 to 2.05 mol per mol of the component (B) (alcohol component).

Examples of the esterification catalyst include Lewis acids, alkali metal compounds and sulfonic acids. Specific examples of the Lewis acids include aluminum derivatives, tin derivatives and titanium derivatives. Specific examples of the alkali metal compounds include sodium alkoxides and potassium alkoxides. Specific examples of the sulfonic acids include p-toluenesulfonic acid, methanesulfonic acid and sulfuric acid. The esterification catalyst may be used, for example, in an amount of about 0.1 to 1.0% by weight on the basis of the total weight of the acid component and the alcohol component as the raw materials.

The lubricant for power transmission according to the present invention contains the alicyclic alcohol carboxylic diester compound represented by the general formula (1). Although the content of the alicyclic alcohol carboxylic diester compound in the lubricant is not particularly limited, the alicyclic alcohol carboxylic diester compound is preferably contained in an amount of 50% by mass or higher, more preferably 70% by mass or higher and most preferably 80% by mass or higher on the basis of the lubricant (composition) to fully exhibit the properties thereof.

In the lubricant for power transmission according to the present invention, the alicyclic alcohol carboxylic diester compound represented by the above general formula (1) may be used in combination with the other base oils. Examples of the base oils include alicyclic hydrocarbon compounds, mineral oils and various synthetic oils. Specific examples of the alicyclic hydrocarbon compounds include alkane derivatives having two or more cyclohexane rings such as 2,4-dicyclohexyl-2-methyl pentane and 2,4-dicyclohexyl pentane, and alkane derivatives having one or more decaline rings and one or more cyclohexyl rings such as 1-cyclohexyl-1-decalyl ethane. Specific examples of the mineral oils include paraffin-based mineral oils and naphthene-based mineral oils. Specific examples of the various synthetic oils include poly-α-olefins such as 1-decene oligomers, polybutene, alkyl benzenes, alkyl naphthalenes, and polyalkylene glycols.

The lubricant for power transmission according to the present invention may further contain known additives unless the addition thereof adversely affects the aimed objects of the present invention. Examples of the additives include extreme pressure agents and anti-wear agents such as sulfur compounds, e.g., sulfurized oils and fats, sulfurized olefins, polysulfides, sulfurized mineral oils, thiophosphoric acids, thiocarbamic acids, thioterpenes and dialkylthiodipropionates, and phosphoric esters and phosphite esters, e.g., tricresyl phosphate and triphenyl phosphite; detergent dispersants such as succinimide and boron-based succinimide; antioxidants such as phenol-based compounds and amine-based compounds; corrosion inhibitors such as benzotriazole-based compounds and thiazole-based compounds; rust preventives such as metal sulfonate-based compounds and succinic ester-based compounds; antifoamers such as silicon-based compounds and silicon fluoride-based compounds; and viscosity index improving agents such as polyemethacrylate-based compounds and olefin copolymer-based compounds. These additives may be added in an appropriate amount according to the aimed applications, and a total amount of the additives blended is usually 20% by mass or lower on the basis of the lubricant (composition).

The form of the lubricant for power transmission according to the present invention is not particularly limited to a lubrication oil kept in a liquid state under ordinary temperature, and the lubricant of the present invention may be usefully used in the form of a grease kept in a semi-solid state under ordinary temperature. The grease for power transmission according to the present invention may be produced, for example, by adding a thickening agent such as metallic soaps, e.g., lithium-based, calcium-based, barium-based, sodium-based and aluminum-based compounds, and non-soap thickeners, e.g., bentonite, silica gel, phthalocyanine and urea resins, to the alicyclic alcohol carboxylic diester compound represented by the above general formula (1). Meanwhile, the grease of the present invention may also be used in combination with the above other base oils, and may be blended with various additives.

The grease for power transmission according to the present invention exhibits a high coefficient of traction, and further undergoes a less evaporation loss due to a high flash point thereof.

EXAMPLES

The present invention is described in more detail by referring to the following examples and comparative examples. However, it should be noted that these examples are only illustrative and not intended to limit the invention thereto. Meanwhile, properties of the lubricant for power transmission were measured by the following methods.

Measurement of Coefficient of Traction (1)

The coefficient of traction was measured by a twin roller tester. That is, a pair of metal rollers (material: bearing steel SUJ-2; diameter: 40 mm; width: 10 mm; hardness: HRC61; surface roughness Rms: 0.030 μm; driven roller: barrel type having a radius of curvature of 20 mm; driver roller: flat type without crowning) were arranged in an opposed relation to each other, and both rotated at an average rotational speed of 6.8 m/s while applying a vertical load of 147.1 N (15 kgf) thereto such that the difference in rotational speed therebetween provided a slip ratio of 5% (value (%) obtained by dividing the difference in rotational speed between the driver and driven rollers by the average rotational speed), to measure a tangential force F (traction force) generated at a contact position therebetween and calculate a coefficient of traction μ (=F/147.1). Meanwhile, the above experiment was conducted by adjusting a temperature of the lubricant to 60° C.

Measurement of Coefficient of Traction (2)

Using the twin roller tester as used in the above measurement of coefficient of traction (1), the coefficient of traction μ was measured under the following conditions. That is, both the rollers were rotated at an average rotational speed of 1.2 m/s while applying a vertical load of 118 N (12 kgf) thereto such that a slip ratio therebetween was 1.7%. The experiment was conducted at 25° C.

Methods for Measuring Other Properties

Flash Point: JIS K 2256
Worked Penetration: JIS K 2220.7
Evaporation Loss: JIS K 2220.10
Pour Point: JIS K 2269
Kinematic Viscosity: JIS K 2283
Viscosity Index: JIS K 2283

Production Example 1

Compound 1: 1,4-cyclohexanediol 3,5,5-trimethylhexanoic diester

A 1 L four-necked flask equipped with a stirrer, a thermometer and a water-fractionating receiver with a cooling tube was charged with 174 g (1.5 mol) of 1,4-cyclohexanediol (1,4-CHD), 568.8 g of 3,5,5-trimethylhexanoic acid (3.6 mol; 1.2 equivalents on the basis of the component (B)), xylene (5% by weight on the basis of a total weight of the raw materials), and p-toluenesulfonic acid as a catalyst (1.0% by weight on the basis of a total weight of the raw materials), and the contents of the flask were gradually heated to 140° C. under a nitrogen atmosphere. Then, the contents of the flask were subjected to esterification reaction under reduced pressure for about 5 h while removing water distilled off by the water-fractionating receiver until reaching a theoretical amount (54 g) thereof After completion of the reaction, excess amounts of the acid and xylene were removed by distillation.

Next, the resultant esterification reaction product was neutralized with an aqueous sodium hydroxide solution which was used in an excess amount relative to a total acid value of the esterification reaction product, and then washed with water until reaching a neutrality, thereby obtaining 576 g of a crude esterification reaction product. As a result, it was confirmed that a content of the obtained diester in the crude esterification reaction product was 96.8% by weight.

Next, the thus obtained crude esterification reaction product was heated to 180° C. under a pressure of 667 Pa to distil off monoesters and esterification by-products therefrom.

After completion of the distillation step, activated alumina and activated carbon were added at 80° C. to the obtained reaction solution in an amount of 0.1% by weight for each on the basis of a theoretical yield of the ester, and the resultant mixture was stirred for adsorption treatment thereof for 1 h. After completion of the adsorption treatment, the reaction mixture was filtered to obtain 500 g of 1,4-cyclohexanediol di(3,5,5-trimethylhexanoate) (Compound 1). Various properties of the thus obtained compound 1 such as coefficient of traction, kinematic viscosity, viscosity index (VI), flash point and pour point thereof, are shown in Table 1.

Production Example 2

Compound 2: 1,3-cyclohexanediol 3,5,5-trimethylhexanoic diester

The same procedure as in Production Example 1 was repeated to conduct the esterification reaction, alkali washing, distillation and adsorption treatment, except that 174 g (1.5 mol) of 1,3-CHD was used in place of 1,4-CHD, and the reaction time was changed to about 22 h, thereby obtaining 511 g of 1,3-cyclohexanediol di(3,5,5-trimethylhexanoate) (Compound 2). Various properties of the thus obtained compound 2 such as coefficient of traction, kinematic viscosity, viscosity index (VI), flash point and pour point thereof, are shown in Table 1.

Production Example 3

Compound 3: 1,2-cyclohexanediol 3,5,5-trimethylhexanoic diester

The same procedure as in Production Example 1 was repeated to conduct the esterification reaction, alkali washing, distillation and adsorption treatment, except that 174 g (1.5 mol) of 1,2-CHD was used in place of 1,4-CHD, the reaction temperature and the reaction time were changed to 180° C. and about 10 h, respectively, and tetraisopropyl titanate was used instead as a catalyst in an amount of 0.5% by weight on the basis of a total weight of the raw materials, thereby obtaining 508 g of 1,2-cyclohexanediol di(3,5,5-trimethylhexanoate) (Compound 3). Various properties of the thus obtained compound 3 such as coefficient of traction, kinematic viscosity, viscosity index (VI), flash point and pour point thereof, are shown in Table 1.

Production Example 4

Compound 4: 1,4-cyclohexane dimethanol 3,5,5-trimethylhexanoic diester

A 1 L four-necked flask equipped with a stirrer, a thermometer and a water-fractionating receiver with a cooling tube was charged with 483.5 g (3.06 mol) of 3,5,5-trimethylhexanoic acid, 216 g (1.5 mol) of 1,4-cyclohexane dimethanol (produced by hydrogenating a nucleus of dimethyl terephthalate in the presence of a ruthenium-supporting molded catalyst to obtain dimethyl 1,4-cyclohexanedicarboxylate, and then hydrogenating the thus obtained dimethyl 1,4-cyclohexanedicarboxylate in the presence of a copper-chromium molded catalyst), xylene (5% by weight on the basis of a total weight of the raw materials), and tin oxide as a catalyst (0.2% by weight on the basis of a total weight of the raw materials), and the contents of the flask were gradually heated to 220° C. under a nitrogen atmosphere. Then, the contents of the flask were subjected to esterification reaction under reduced pressure for about 8 h while removing water distilled off by the water-fractionating receiver until reaching a theoretical amount (72 g) thereof. After completion of the reaction, an excess amount of the acid was removed by distillation. Next, the resultant esterification reaction product was neutralized with an aqueous sodium hydroxide solution which was used in an excess amount relative to a total acid value of the esterification reaction product, and then washed with water until reaching a neutrality, thereby obtaining a crude esterification reaction product. Further, the thus obtained crude esterification reaction product was treated with activated carbon, and then filtered to obtain 568 g of 1,4-cyclohexane dimethanol di(3,5,5-trimethylhexanoate) (Compound 4). It was confirmed that the resultant ester had a total acid value of 0.01 mg KOH/g, an iodine number of less than 0.1 $I_2$g/100 g and a molar ratio of cis-isomer to trans-isomer of 29/71. Various properties of the thus obtained compound 4 such as coefficient of traction, kinematic viscosity, viscosity index (VI), flash point and pour point thereof, are shown in Table 1.

Compound 5: (Dimerized Norbornane Compound)

Using crotonaldehyde and dicyclopentadiene as raw materials, the method as described in Example 12 of Japanese Patent Publication No. 103387/1995 was conducted to obtain a dimerized norbornane compound. As a result, it was confirmed that the thus obtained dimerized norbornane compound had a kinematic viscosity of 21.8 $mm^2/s$ as measured at 40° C.

Examples 1 to 4 and Comparative Examples 1 and 2

The lubricants for power transmission (compounds 1 to 4) obtained in Production Examples 1 to 4 (Examples 1 to 4) and the comparative lubricants for power transmission shown in Table 1 (Comparative Examples 1 and 2) were subjected to measurements of coefficient of traction (1), kinematic viscosity, viscosity index (VI), flash point and pour point thereof. The results are shown in Table 1.

TABLE 1

| Examples and Comparative Examples | Composition of lubricant | Kinematic viscosity [$mm^2/s$] 40° C. | 100° C. |
|---|---|---|---|
| Example 1 | Compound 1 | 38.3 | 5.99 |
| Example 2 | Compound 2 | 30 | 4.98 |
| Example 3 | Compound 3 | 24.1 | 4.15 |
| Example 4 | Compound 4 | 37.4 | 6.26 |
| Comparative Example 1 | 2-Methyl-2,4-dicyclohexyl pentane | 19.9 | 3.56 |
| Comparative Example 2 | Diester of isononanol and 2,4-diethyl glutaric acid | 16.0 | 3.52 |

TABLE 1-continued

| Examples and Comparative Examples | Viscosity index | Pour point [° C.] | Flash point [° C.] | Coefficient of traction (1) at 60° C. |
|---|---|---|---|---|
| Example 1 | 99 | −40 | 205 | 0.090 |
| Example 2 | 85 | −40 | 190 | 0.089 |
| Example 3 | 49 | −45 | 200 | 0.091 |
| Example 4 | 116 | −45 | 222 | 0.082 |
| Comparative Example 1 | 18 | −45 | 164 | 0.115 |
| Comparative Example2 | 97 | <−50 | 216 | 0.060 |

Examples 5 to 8 and Comparative Examples 3 and 4

The compounds as shown in Table 2 were blended with each other to produce a grease by the following method. The coefficient of traction (2), worked penetration and evaporation loss of the thus obtained grease were measured. The results are shown in Table 2.

Method for Preparation of Grease

An alicyclic alcohol carboxylic diester compound, a dimerized norbornane compound, etc., were added as a base oil to a grease production vessel and blended with each other therein. Then, a given amount of a raw thickener material as shown in Table 2 was added to the base oil, and the obtained mixture was then heated while stirring. After the time at which a temperature of the obtained grease reached 200° C., the grease was held at 200° C. for 5 min. Next, the grease was cooled to 100° C. at a temperature drop rate of 50° C./h, and then mixed with an antioxidant and a rust preventive as shown in Table 2. Thereafter, the resultant mixture was naturally cooled to room temperature, and then subjected to finishing treatment using a three-roll device, thereby obtaining a grease as a final product.

TABLE 2

| | Examples 5 | 6 | Comparative Examples 3 | 4 |
|---|---|---|---|---|
| Blending ratio (wt %) | | | | |
| Compound 3 | 85.1 | 93.5 | | |
| Compound 5 (Dimerized norbornane compound) | | | 94.3 | |
| Pentaerythritol n-heptanoic triester | | | | 93.1 |
| Thickening agent*1 | 12.9 | 4.5 | 3.7 | 4.9 |
| Antioxidant*2 | 1.0 | 1.0 | 1.0 | 1.0 |
| Rust preventive*3 | 1.0 | 1.0 | 1.0 | 1.0 |
| Properties | | | | |
| Worked penetration (—) | 205 | 395 | 402 | 410 |
| Evaporation loss (99° C. × 22 h; wt %) | 0.3 | 0.3 | 21.5 | 0.3 |
| Coefficient of traction (2) at 25° C. (—) | 0.088 | 0.093 | 0.118 | 0.030 |

Note)
*1Lithium 12-hydroxystearate (industrial grade)
*2N-phenyl-1-naphthylamine
*3Ca sulfonate

INDUSTRIAL APPLICABILITY

The lubricant for power transmission according to the present invention exhibits not only a high coefficient of traction but also a high flash point. Therefore, the lubricant of the present invention can allow a power transmission having a traction drive type transmission mechanism to show a large power transmission capacity, and can exhibit a high safety upon handling. As a result, the lubricant of the present invention can be usefully used as lubricants for power transmissions of industrial equipments and automobiles as well as those for power transmissions of airplanes.

What is claimed is:

1. A lubricant comprising an alicyclic alcohol carboxylic diester compound represented by the formula (1):

$$R^1—CO—O—Z—O—CO—R^2 \quad (1)$$

wherein Z is a cycloalkylene group having 6 to 8 carbon atoms and $R^1$ and $R^2$ are each 2,4,4-trimethylpentyl, wherein the alicyclic alcohol carboxylic diester compound has a flash point of 180° C. or higher, and wherein the alicyclic alcohol carboxylic diester compound is contained in an amount of 80% by mass or larger on the basis of the weight of the lubricant.

2. The lubricant according to claim 1, wherein the alicyclic alcohol carboxylic diester compound has a flash point of 200° C. or higher.

3. The lubricant according to claim 1, wherein the lubricant is useful in a power transmission having a traction drive type transmission mechanism.

4. The lubricant according to claim 1, wherein the lubricant is in the form of a grease.

5. The lubricant according to claim 1, said lubricant further comprising a base oil.

6. The lubricant according to claim 5, wherein said base oil is selected from the group consisting of 2,4-dicyclohexyl-2-methyl pentane, 2,4- dicyclohexyl pentane, 1-cyclohexyl-1-decalyl ethane, 1-decene oligomers, polybutene, alkyl benzenes, alkyl naphthalenes, and polyalkylene glycols.

7. The lubricant according to claim 5, further comprising one or more additives selected from the group consisting of extreme pressure agents, anti-wear agents, detergent dispersants, antioxidants, corrosion inhibitors, rust preventives, antifoamers, and viscosity index improving agents.

8. The lubricant according to claim 4, further comprising at least one thickening agent.

9. The lubricant according to claim 8, wherein said thickening agent is selected from the group consisting of lithium-based, calcium-based, barium-based, sodium-based and aluminum-based metallic soaps, bentonite, silica gel, phthalocyanine, urea resins, and mixtures thereof.

* * * * *